US006691887B2

(12) United States Patent
Christensen et al.

(10) Patent No.: US 6,691,887 B2
(45) **Date of Patent: *Feb. 17, 2004**

(54) UNDERGROUND RAKE STORAGE APPARATUS AND METHOD

(75) Inventors: Warren J. Christensen, 2930 Oakview Cir., Salt Lake City, UT (US) 84121; Dave Meyers, Kaysville, UT (US)

(73) Assignee: Warren J. Christensen, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/107,273

(22) Filed: Mar. 26, 2002

(65) Prior Publication Data

US 2002/0153267 A1 Oct. 24, 2002

Related U.S. Application Data

(63) Continuation-in-part of application No. 09/840,391, filed on Apr. 23, 2001.

(51) Int. Cl.[7] ..... B65D 25/00
(52) U.S. Cl. ..... 220/484; 206/349
(58) Field of Search ..... 220/484, 501; 56/400.01; 206/244, 315.2, 341, 443

(56) References Cited

U.S. PATENT DOCUMENTS

| | | | | |
|---|---|---|---|---|
| 2,436,631 | A | | 2/1948 | Cohn |
| 2,528,056 | A | | 10/1950 | Henry |
| 2,757,045 | A | | 7/1956 | Hullet |
| 2,791,347 | A | | 5/1957 | Bechm |
| 2,857,863 | A | | 10/1958 | Dwyer |
| 3,233,367 | A | | 2/1966 | Hagle |
| 3,515,263 | A | | 6/1970 | Carlson |
| 3,584,739 | A | | 6/1971 | Erichson |
| 4,224,786 | A | * | 9/1980 | Langlie et al. ..... 56/400.01 |
| 4,669,625 | A | | 6/1987 | Armstrong |
| 4,838,416 | A | | 6/1989 | Carman |
| 4,934,550 | A | | 6/1990 | Cash |
| 5,042,812 | A | | 8/1991 | Tillman |
| 5,735,430 | A | | 4/1998 | Gorman |
| 6,223,926 | B1 | | 5/2001 | Craven et al. |
| 6,308,854 | B2 | | 10/2001 | Craven et al. |
| 6,405,891 | B1 | * | 6/2002 | Christensen et al. ..... 220/484 |

* cited by examiner

*Primary Examiner*—Joseph Moy
(74) *Attorney, Agent, or Firm*—Thorpe North & Western LLP

(57) ABSTRACT

A rake storage system to store a rake adjacent a sand trap of a golf course, and to selectively elevate the rake for use, includes an elongated container to be disposed underground adjacent the sand trap in a substantially vertical orientation. A rake is removably disposed within the elongated container. A mechanical lifting mechanism is disposed in the elongated container to elevate the rake. A releasable retaining mechanism is disposed in the container to retain the rake in the container, and includes a lip formed in the container, and a protrusion disposed on the rake near the distal end adjacent the rake head. The protrusion is engagable with the lip to retain the rake in the container when the rake is disposed in the container. A flange can be formed about the inside of the container. A collar can be disposed around the rake near a distal end adjacent a rake head to engage the flange when the rake is received within the container to substantially close the container below the flange and the collar.

17 Claims, 8 Drawing Sheets

UNDERGROUND RAKE STORAGE APPARATUS AND METHOD

This application is a continuation-in-part of U.S. patent application Ser. No. 09/840,391, filed Apr. 23, 2001.

BACKGROUND OF THE INVENTION

1. Field of the Invention

The present invention relates generally to method and apparatus for storing a rake adjacent a sand trap of a golf course, and for selectively elevating the rake for use.

2. Related Art

Golf courses are typically provided with hazards, such as sand traps which are disposed about the greens and fairways of the golf course. During play, golf balls are often shot into a sand trap. In order to continue play, the player must enter the sand trap and shoot the golf ball out. Playing the ball from the sand trap leaves footprints in the sand, and creates a divot from the swing. These disturbances in the sand trap, if left unattended, can affect the roll of the next ball hit into the sand trap. As a courtesy to other players and/or under the rules of the game, the player must leave the sand trap in its original or undisturbed condition. For this purpose, one or more rakes typically are provided at each sand trap. The player can use the rake to smooth the sand in the sand trap.

Leaving rakes along side or in the sand traps results in numerous disadvantages. One disadvantage of leaving rakes along side a sand trap is the potential that a golf ball will strike the rake, and thus interfere with the shot. In addition, rakes left along side the sand trap are esthetically displeasing. In addition, such rakes may present a safety hazard to players who might inadvertently step on, or trip over, the rake. In addition, golf carts may inadvertently run over and break the rake. Furthermore, maintenance of the course is made more difficult as workers must move the rakes as they mow the course, and/or tractor-rake the sand trap. Another disadvantage of leaving rakes about the sand trap is that such rakes tend to migrate to one end or location of the sand trap. In addition, sunlight tends to destroy the fiberglass handle of rakes that are left out.

Various devices have been developed in an attempt to solve the above-mentioned problems. For example, U.S. Pat. No. 3,584,739 issued to Erichson discloses a container buried in the ground adjacent the sand trap with a hinged cover having an artificial turf surface. When not in use, the rake is stored in a horizontal orientation in the container. As further examples, U.S. Pat. No. 4,934,550 issued to Cash, and U.S. Pat. No. 5,042,812 issued to Tillman, both disclose a container buried under the ground surface. One disadvantage with these types of underground containers is the difficulty and inconvenience of retrieving the rake from the underground container. For example, the player may have to bend over, squat, or kneel to withdraw the rake from the container. Alternatively, the player may have to fish the rake out of the container by hooking part of the rake with a golf club and carefully raising the rake to a position in which it may be grasped.

SUMMARY OF THE INVENTION

It has been recognized that it would be advantageous to develop a system or method for storing a rake adjacent a sand trap of a golf course in such a way as to minimize any interference of the rake with play, speed up play, increase the esthetic appearance of the course, improve the safety of the players, and increase the efficiency of course maintenance.

In addition, it has been recognized that it would be advantageous to develop a system or method for more easily retrieving the rake for use, and returning for storage.

The invention provides an underground rake storage system and a rake device for use with such a system. The underground rake storage system can include a vertically oriented, elongated container disposed underground adjacent a sand trap of a golf course. In addition, a mechanical lifting mechanism can be disposed in the container to elevate the rake. The rake can include an elongated handle with proximal and distal ends. A rake head can be disposed on the distal end of the handle, and can have an edge to rake sand. A protrusion advantageously can be disposed on the distal end of the handle proximate the rake head. The protrusion can engage and can be retained by the underground rake storage system to maintain the rake in the container.

In accordance with one aspect of the present invention, a releasable retaining mechanism can retain the rake in the container. The retaining mechanism can include a lip formed in the container. The protrusion engages with the lip to retain the rake in the container when the rake is disposed in the container. The lip can be pivotally coupled in the container. The lip can pivot between 1) a retaining position closer to the rake and engagable by the protrusion when the lid is in the open position, and 2) a release position further from the rake and the protrusion when the lid is in the closed position.

In accordance with another aspect of the present invention, a collar can be disposed around the rake near the distal end adjacent the rake head, and can form the protrusion. A matching flange can be formed about the inside of the container. The collar can be disposed at the flange when the rake is received within the container to substantially close the container below the flange and the collar. The container can include a sealed lower end for areas with a high water table. Thus, the collar and flange prevent water from entering the container. The flange can include an upwardly-facing, tapering wall. Similarly, the collar can include a downwardly-facing, tapering wall that matches the upwardly-facing, tapering wall of the flange.

In accordance with another aspect of the present invention, a lid can be pivotally coupled to the container. The lid can be pivotal between: 1) an open position in which the rake can be removed from and inserted into the container; and 2) a closed position covering an open upper end of the container. In addition, the lip can be coupled to the lid to pivot with the lid. Furthermore, the lid is sized to extend over the open upper end of the container, and includes a downwardly-extending ridge extending past the open upper end of the container when the lid is in the closed position.

In accordance with another aspect of the present invention, indicia can be formed on the lid. The indicia can indicate a distance to a green of the golf course.

In accordance with another aspect of the present invention, the mechanical lifting mechanism can include: a counter weight system; a compression spring system; an extension spring system; an elastic system; a magnetic system; a ratchet mechanism; a wheel and strap system; a lever system; a pneumatic system; a hydraulic system; an electric motor system; and a strap system.

Additional features and advantages of the invention will be apparent from the detailed description which follows, taken in conjunction with the accompanying drawings, which together illustrate, by way of example, features of the invention.

DETAILED DESCRIPTION

Figure 1:
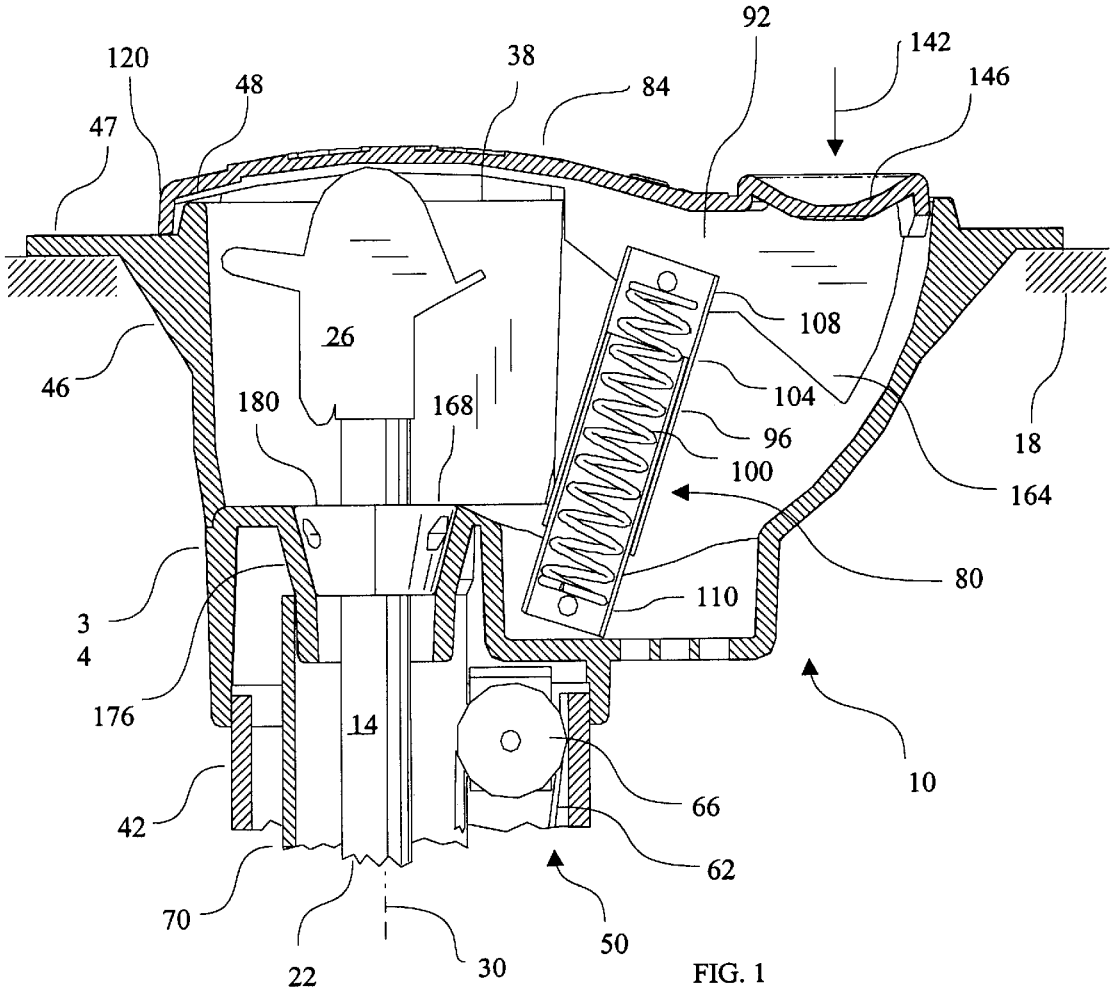
FIG. 1 is a partial cross-sectional side view of an underground rake storage system in accordance with an embodiment of the present invention showing an underground container in a closed configuration with a rake disposed therein.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1–6, a rake storage system or device, indicated generally at 10, is shown for storing a rake 14 adjacent a sand trap of a golf course. In one aspect, the system 10 is configured to store the rake 14 underground, or substantially under a surface 18 of the golf course. Golf courses and rakes are examples of fields that may benefit from the use of the rake storage system 10. Various aspects of an underground rake storage system are described in U.S. patent application Ser. No. 09/840,391, which is herein incorporated by reference.

The rake 14 can have an elongated handle 22 with a proximal end that is grasped by the user, and a rake head 26 formed on a distal end thereof for contacting and manipulating the sand. The rake 14 also has a longitudinal axis 30 that can be generally parallel and concentric with the handle 22. The head 26 of the rake 14 can include a plurality of fingers along one edge, and a substantially continuous edge opposite the fingers, to rake the sand of the sand trap. It is of course understood that the rake 14 can have various different configurations. As described in greater detail below, the rake 14 advantageously can be configured to facilitate retention underground.

The rake storage system or device 10 also includes an elongated container 34 configured to removably receive the rake 14 therein. The elongated container 34 can be disposed underground, or under the surface 18 to conceal and/or position the container 34 and the rake 14. The container 34 includes an opening 38 through which the rake 14 passes into, and out of, the container 34. The opening 38 can be located at the end or top of the elongated container 34. The top of the container 34 or opening 38 preferably is located generally flush with the surface 18. Thus, the rake 14 and container 34 are located underground to avoid interference with play, improve aesthetics, and prevent interference with maintenance, while still remaining visible to facilitate locating the rake when needed.

In one aspect, the container 34 can be configured to substantially match the shape or configuration of the rake 14. The container 34 may include an elongated main tube 42, and a trough or tray 46 disposed at the end of the main tube 42. The main tube 42 is configured to receive the handle 22 of the rake 14, while the tray 46 is configured to receive the head 26. The opening 38 of the container 34 may be formed in the tray 46.

The container 34 or the tray 46 can include an outer flange 47 formed near the upper end thereof, and extending outwardly therefrom. The flange 47 can be disposed on or at the surface 18. In addition, the container 34 or the tray 46 can include an upper lip 48 formed around the opening 38 and extending upwardly therefrom. Thus, the upper lip 48 can extend above the surface 18 and resist run-off or water flow from entering the container 34 through the opening.

Figure 7:
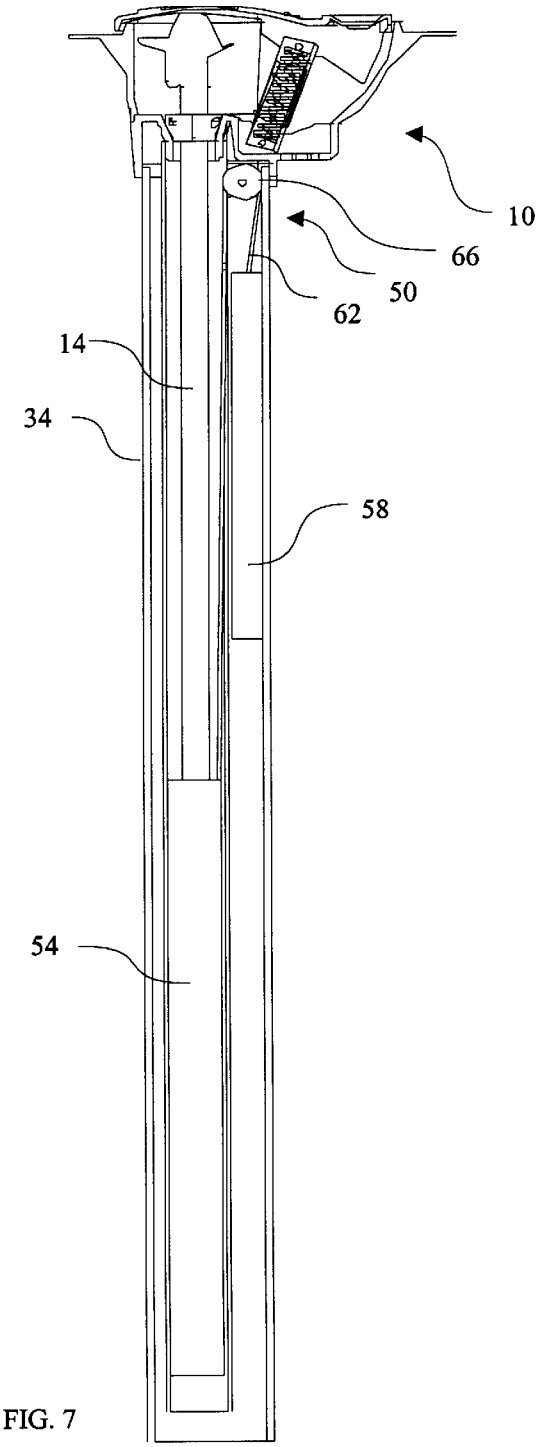
FIG. 7 is a cross-sectional side view of the underground rake storage system of FIG. 1.
Figure 8:
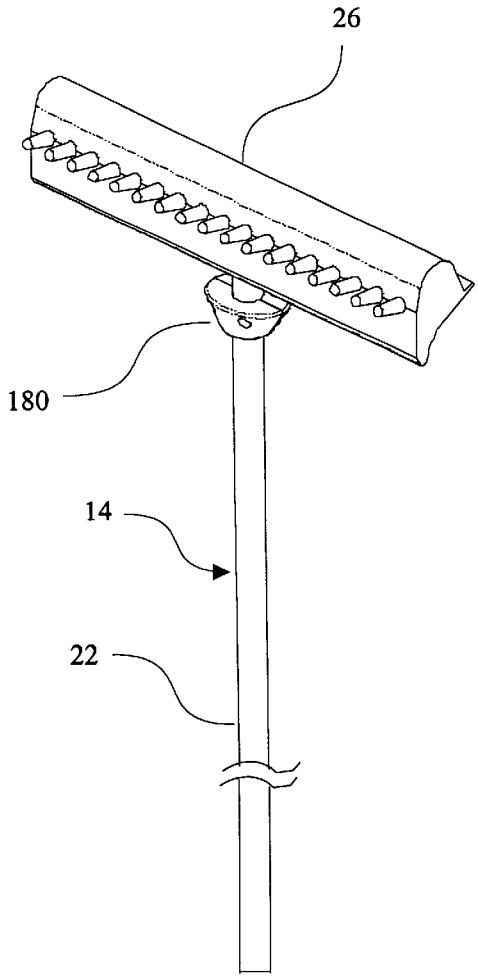
FIG. 8 is a perspective view of the rake of the underground rake storage system in accordance with an embodiment of the present invention.

The underground rake storage system or device 10 of the present invention advantageously includes a mechanical lifting mechanism to vertically elevate the rake 14, or eject the rake 14 from the container 34. Referring to FIG. 7, the lifting mechanism advantageously can include a counter weight system 50. A receiver or receiver tube 54 (FIG. 2) can be moveably disposed in the elongated container 34 or main tube 42 to receive the proximal end of the rake 14 therein. The receiver 42 can be operatively coupled to a counter weight 58 (FIG. 7), which is also movably disposed in the elongated container 34 or main tube 42. The counter weight 58 operates to elevate the receiver 54 (FIG. 2), and thus the rake 14. The receiver 54 (FIG. 2) and the counter weight 58 can be operatively coupled by a cord 62. The cord 62 in turn can operatively engage a pulley 66 disposed near the top of the elongated container 34, or at the top of the main tube 42.

The receiver 54 and the counter weight 58 move or slide up and down within the main tube 42. The cord and pulley 62 and 66 cause the receiver 54 and counter weight 58 to move in different directions, with the counter weight 58 moving in a downward direction as the receiver 54 moves in an upward direction, and vise versa.

The counter weight 58 can have a weight, which is greater than a combined weight of both the rake 14 and the receiver 54. Thus, the counter weight 58 tends to move in a downward direction under the force of gravity causing the receiver 54 with the rake 14 therein to move in an upward direction. In one aspect, the counter weight 58 weighs only slightly more than both the rake 14 and receiver 54 to cause the receiver 54 and rake 14 to move upwardly in a slow, smooth motion. The slow motion or elevation of the rake 14 resists surprise or possible injury.

The lifting mechanism can be configured to elevate the rake 14 a significant distance to facilitate retrieval of the rake 14 from the container 34. Preferably, the lifting mechanism elevates the head 26 of the rake 14 to a convenient, graspable elevation greater than approximately 2 feet, and more preferably greater than approximately 3 feet. It will be appreciated that the counter weight system 50 can be configured to elevate the rake 14 a desired distance, which is limited by the length of the cord 62 and the length of the counter weight 58 in the length of the main tube 42. Thus, the length of the cord 62 and counter weight 58 can be selected such that the head 26 of the rake 14 is elevated to the desired elevation. The lifting mechanism advantageously elevates the rake 14 to an elevation where the user may easily grasp the rake 14, handle 22 or head 26 thereof.

Figure 2:
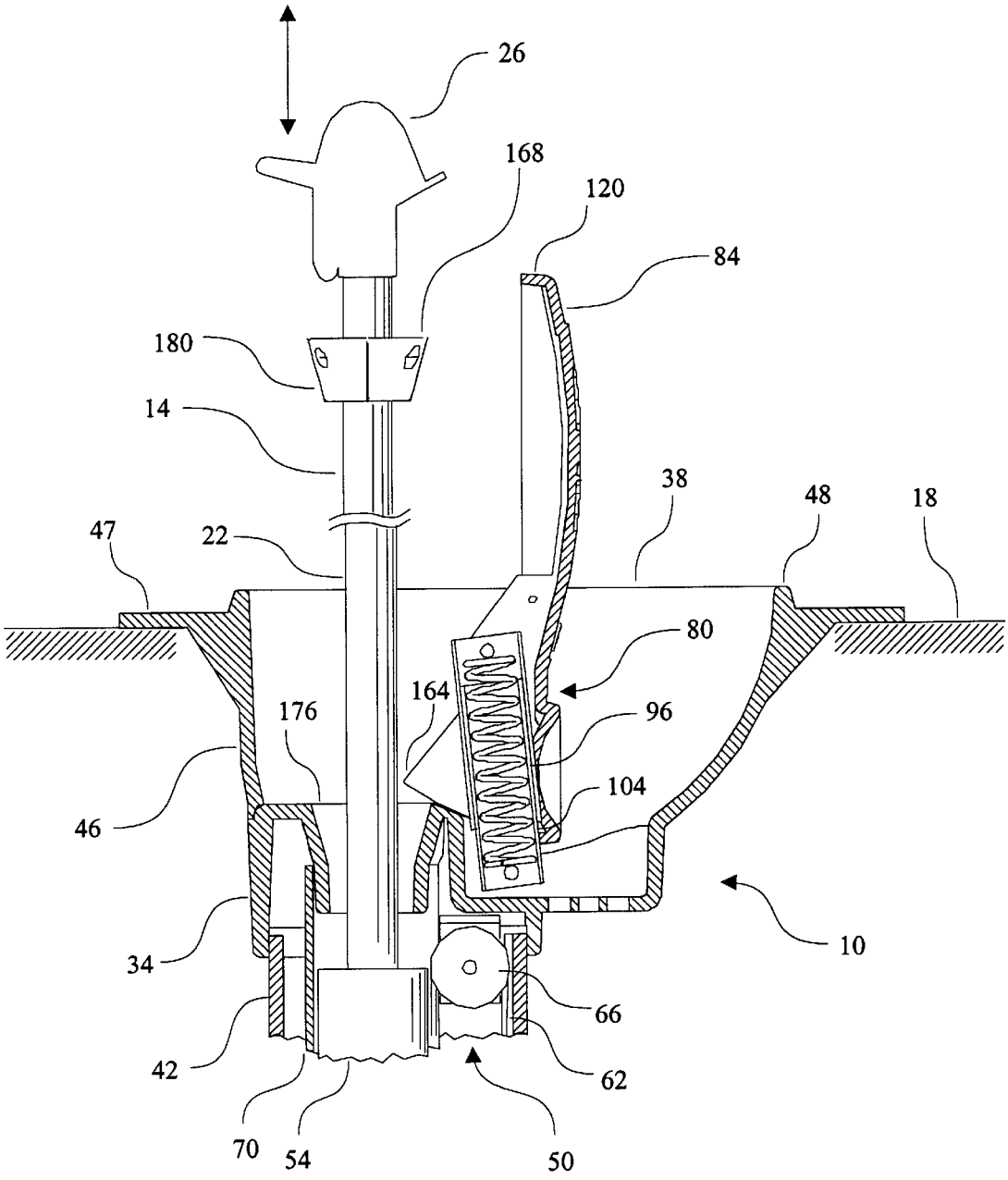
FIG. 2 is a partial cross-sectional side view of the underground rake storage system of FIG. 1 showing the container in an open configuration with the rake elevated therefrom.

The lifting mechanism or counter weight system 50 moves or displaces the rake 14 between a storage elevation, as shown in FIG. 1, and a graspable elevation, as shown in FIG. 2. In the storage elevation, the rake 14 is disposed under the surface 18, and within the container 34. At the graspable elevation, the head 26 of the rake 14 is disposed above the surface 18, and out of the container 34.

As stated above, the container 34 and rake 14 preferably are disposed in a vertical orientation. Therefore, the lifting mechanism or counter weight system 50 advantageously elevates the rake in a vertical direction, and along the longitudinal axis 30 of the rake 14. Thus, the length of the rake 14 or the handle 22 itself is utilized in providing the rake 14 or head 26 thereof at a graspable elevation.

Although the container 34 and rake 14 are shown in a vertical orientation, it is of course understood that the rake 14 and container 34 can be disposed at a vertical incline, or at an angle with respect to the surface 18. Such a configuration might be useful if the system 10 is disposed in an angled side of a sand trap or bunker.

An additional advantage of the counter weight system 50 is that the counter weight 58 and pulley 66 can be configured such that the rake 14 is slowly elevated out of the container. It will be appreciated that the counter weight system 50 causes the rake 14 to slowly elevate as the counter weight 58 slowly overcomes its inertia and builds momentum. The slow elevation of the rake 14 advantageously allows the user time to react and grasp the rake. In addition, such slow displacement resists surprises and/or injury.

The counter weight system 50 is one example of a mechanical lifting mechanism or a lifting means for elevating the rake 14. It is of course understood that other lifting means for elevating the rake 14 may be used, including for example, an electric motor, hydraulics, a hydraulic actuator, a hydraulic motor, pneumatics, a pneumatic actuator, a pneumatic motor, a spring or other stored energy force, etc.

A guide tube 70 or guide track may be disposed in the main tube 42. The receiver or receiver tube 54 can be slideably disposed in the guide tube 70. The guide tube 70 prevents the receiver 54 and counter weight 58 from interfering with one another as they move.

The underground rake storage system or device 10 also advantageously includes a holding or latching mechanism to selectively or releasably secure the rake 14 in the container 34. The holding or latching mechanism operates to prevent the lifting mechanism or counter weight system 50 from elevating the rake 14 out of the container 34 until desired. The holding or latching mechanism may engage the rake 14 to prevent the rake from exiting the container 34, or may engage the lifting mechanism or counter weight system 50 to prevent the lifting mechanism or counter weight system 50 from operating.

The holding or latching mechanism can include a bi-stable mechanism 80 disposed in the container 34 or the tray 46 for engaging the rake 14 and selectively or releasably holding the rake in the container 34. The bi-stable mechanism 80 preferably has two stable positions, and thus tends to move to either of the two stable positions. The two stable positions of the bi-stable mechanism 80 preferably correspond to a secure position, as shown in FIG. 1, and an open position as shown in FIG. 2. In the secure position, the mechanism 80 operates to retain the rake 14 within the container 34. In the open position, the mechanism 80 allows the rake 14 to be removed from the container 34, or allows the lifting mechanism to elevate the rake 14.

The bi-stable mechanism 80 can include a lid or pivot member 84 pivotally coupled to the container 34 or the tray 46. The lid or pivot member 84 extends over the rake 14 when the rake is disposed in the container 34. The lid or pivot member 84 can pivot between open and closed positions. In the closed position, the lid or pivot member 84 extends over the rake 14 and container 34. In the open position, the lid can pivot away from the opening 38 of the container 34 to allow the rake 14 to be removed from, and inserted into, the container. The lid or pivot member 84 also includes a bias portion or arm 92, which engages a spring element 96. The bias portion 92 engages the spring element 96 as the pivot member 84 pivots.

The spring element 96 of the bi-stable mechanism 80 can include a compression spring or coil spring 100. The spring 100 can be contained in a housing 104 to protect the spring 100, maintain the linear compression and expansion of the spring, and provide attachment of the spring. The housing 104 can include first and second portions 108 and 110 which slide or move with respect to each other as the spring is compressed and expanded. The first portion 108 can be pivotally attached to the biasing portion or arm 92 of the pivot member 84, while the second portion 110 can be pivotally attached to the container 34 or tray 46. The bias portion 92 of the lid or pivot member 84 causes the spring 100 to compress as the lid or pivoting member 84 pivots. Thus, the spring 100 tends to force the lid or pivot member 84 towards either of the two positions, and provides resistance to movement of the lid or pivot member 84 out of either of the two positions.

The bi-stable mechanism 80 is one example of a holding or latching mechanism for selectively and/or positively maintaining the rake 14 within the container 34, and/or for selectively activating the lifting mechanism. It is of course understood that other means for selectively maintaining the rake 14 in the container 34 can be used, including for example, a pressure release catch, magnetic latch, a two-way latch, etc. As stated above, the holding or latching mechanism may be configured to engage the rake 14 itself, or can be configured to engage the lifting mechanism or counter weight system 50. For example, a pressure release catch or magnetic latch may be disposed in the bottom of the container 34 or main tube 42 to engage and releasably secure the receiver 54, and thus selectively prevent movement of the counter weight.

The lid 84 can be sized and configured to wholly or partially cover the opening 38 of the tray 46 or container 34. In one aspect, the lid 84 extends over the entire opening 38, as shown, to resist water and debris from entering the container 34. In another aspect, the lid 84 extends over at least the main tube 42 to resist water and debris from entering the main tube 42. The lid 84 can have a downwardly projecting lip 120 formed about a periphery thereof and that extends around the upper lip 48 of the container 34 or opening 38 in the closed position to further resist water and debris from entering the container 34. The lid 84 is disposed over the rake 14 in the closed position, and prevents withdrawal of the rake 14 from the container 34, or prevents the lifting mechanism from elevating the rake 14.

The lid 84 has an upper surface 130 that preferably is sized to have indicia 134 thereon. The indicia 134 can include information and/or advertising, including for example, the distance to the hole or green, the name of the course, the name or logo of a sponsor or advertiser, etc. The indicia 134 can be provided on removable inserts 138 attached to, or received in indentations in, the upper surface of the lid 84. In addition, indicia also can be formed on the container 34, such as the outer flange 47 of the tray 46 or container 34.

The tray 46 may be configured with a bottom wall which tapers downwardly away from the center of the tray 46, and thus away from the opening in the main tube 42, to prevent water and debris from being directed into the main tube 42.

In use, the lid 84 extends over the rake 14 and container 34 in the closed position, preventing the lifting mechanism from elevating the rake 14. Thus, the rake head 26 can abut the lid 84 in the closed position under the force from the lifting mechanism, as shown in FIG. 1. To release or elevate the rake 14, a user can press on the arm 92, indicated by arrow 142, such as with the end of a golf club, or with the toe of their foot. The arm 92 can have an indentation 146 formed therein to receive the end of a golf club, and resist slipping of the golf club while pressed 142 against the arm 92. Pressing 142 on the arm 92 causes the arm 92 to pivot downwardly, and the lid 84 to pivot upwardly, while compressing the spring element 96. The spring element 96 or bi-stable mechanism 80 also pivots from one stable position to another. Thus, as the lid 84 pivots from the closed position to the open position, the spring element 96 or bi-stable mechanism 80 moves to the other stable position, holding the lid 84 in the open position. With the lid 84 open, the lifting mechanism or counter weight system 50 elevates the rake for use.

After the user is finished using the rake 14, the user can insert the rake 14 or handle 22 into the receiver 54 (FIG. 2), and push the rake 14 into the container 34, indicated by arrow 150 (FIG. 3), against the force of the lifting mechanism or counterweight system 50, such as with their foot. When the rake 14 is inserted into the container 34, the user can close the lid 84, such as by pivoting the lid 84, indicated by arrow 150 (FIG. 3), such as with their foot. Again, pivoting the lid 84 from the open position to the closed position causes the spring element 96 or bi-stable mechanism to move back to its first stable position, maintaining the lid 84 in the closed position.

As stated above, the rake 14 and container 34 advantageously can be configured to facilitate retaining the rake 14 in the container 34, and to resist water and debris entering the container 34. It has been recognized that the lifting mechanism or counter weight mechanism 50 can elevate the rake 14 after the user has pushed 150 the rake into the container, and while the user is pivoting 154 the lid 84 into the closed position, possibly causing interference between the lid 84 and rake head 36. In addition, it has been recognized that a user might push 150 the rake 14 into the container 34, but forget to pivot 154 the lid 84 into the closed position, causing the lifting mechanism or counter weight mechanism 150 to elevate the rake.

Thus, the system 10 advantageously includes a retaining mechanism 160 (FIG. 3) to retail the rake 14 in the container 34, even if the lid 84 is left open, and to resist the rake head 26 from interfering with the lid 84 when the lid is being closed. The retaining mechanism 160 includes a lip 164 and a protrusion 168 that engage one another to retain the rake 14 in the container 34. The lip 164 is disposed in the container 34 and extends towards the rake 14 or handle 22 when the rake is disposed in the container. The protrusion 168 extends from the rake 14 or handle 22 at the distal end, adjacent the rake head 26. Thus, the lip 164 in the container 34 and the protrusion 168 on the rake 14 are positioned with the lip 164 above the protrusion 168 when the rake is inserted into the container to retain the rake in the container. In one aspect, the lip and protrusion 164 and 168 are sized to provide an interference fit therebetween so that the protrusion 168 is forced past the lip 164 when the rake is inserted into the container, and thus abuts to the lip under the force of the lifting mechanism or counter weight mechanism, to resist elevation of the rake.

Figure 3:
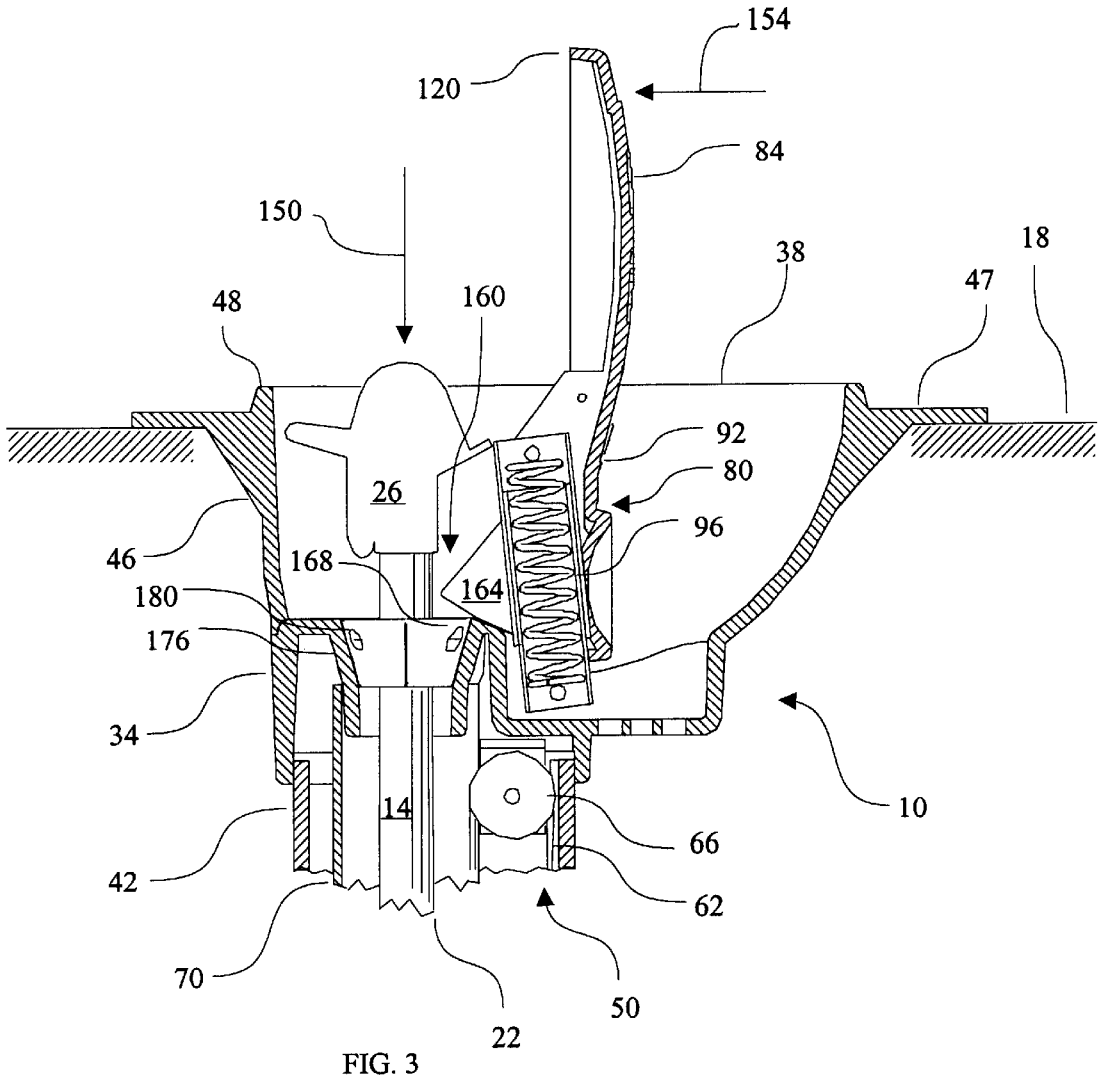
FIG. 3 is a partial cross-sectional side view of the underground rake storage system of FIG. 1 showing the container in an open configuration with the rake disposed therein.
Figure 4:
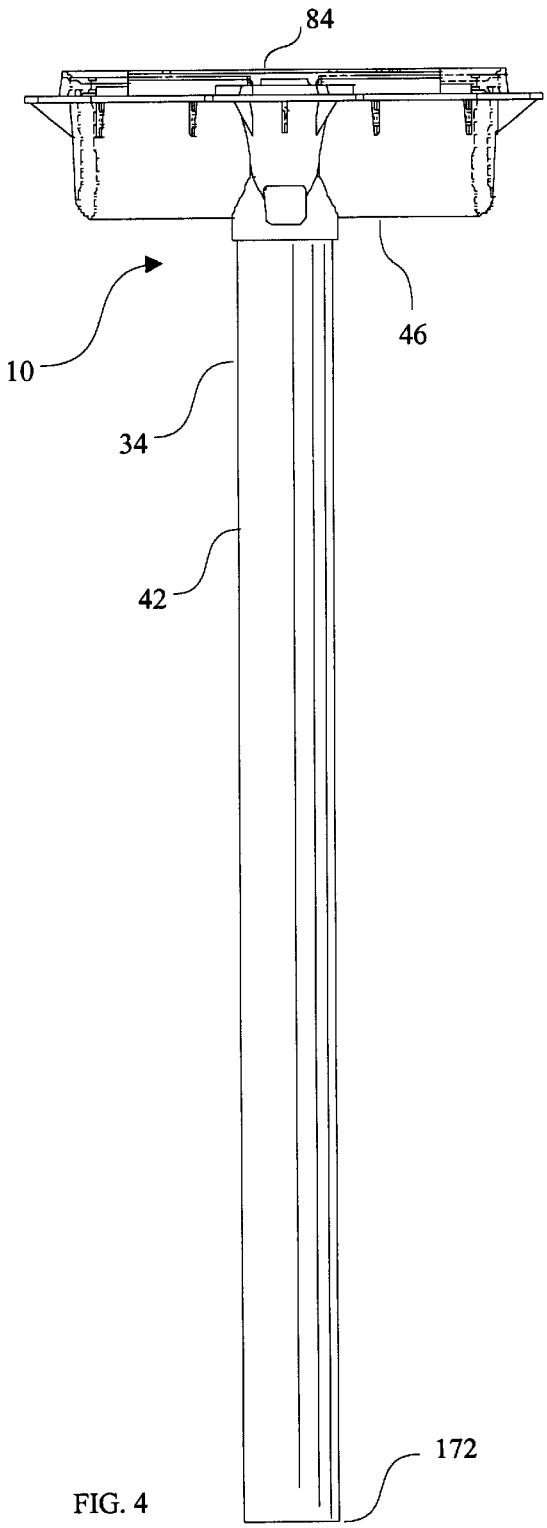
FIG. 4 is a front view of the underground rake storage system of FIG. 1.
Figure 5:
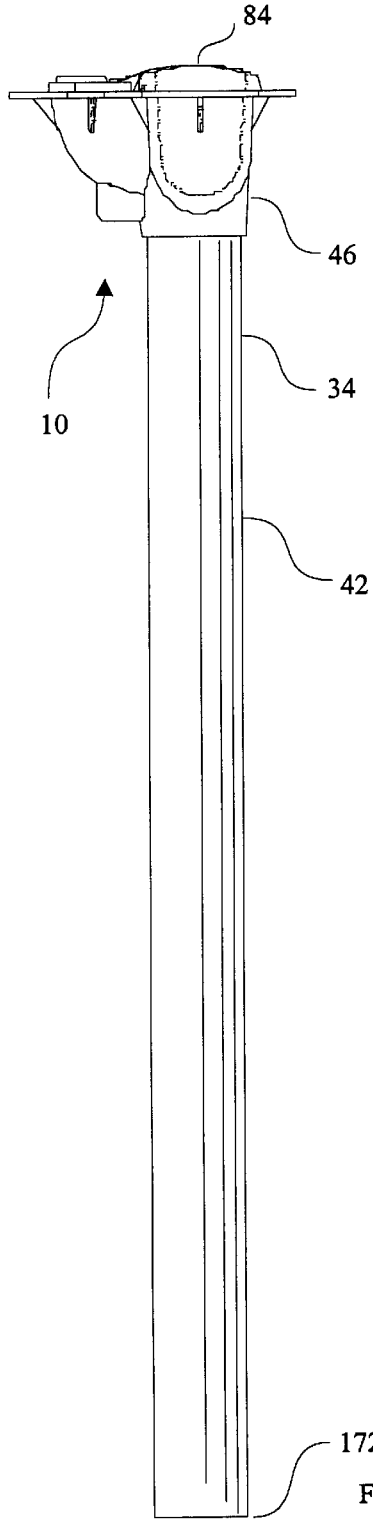
FIG. 5 is a side view of the underground rake storage system of FIG. 1.
Figure 6:
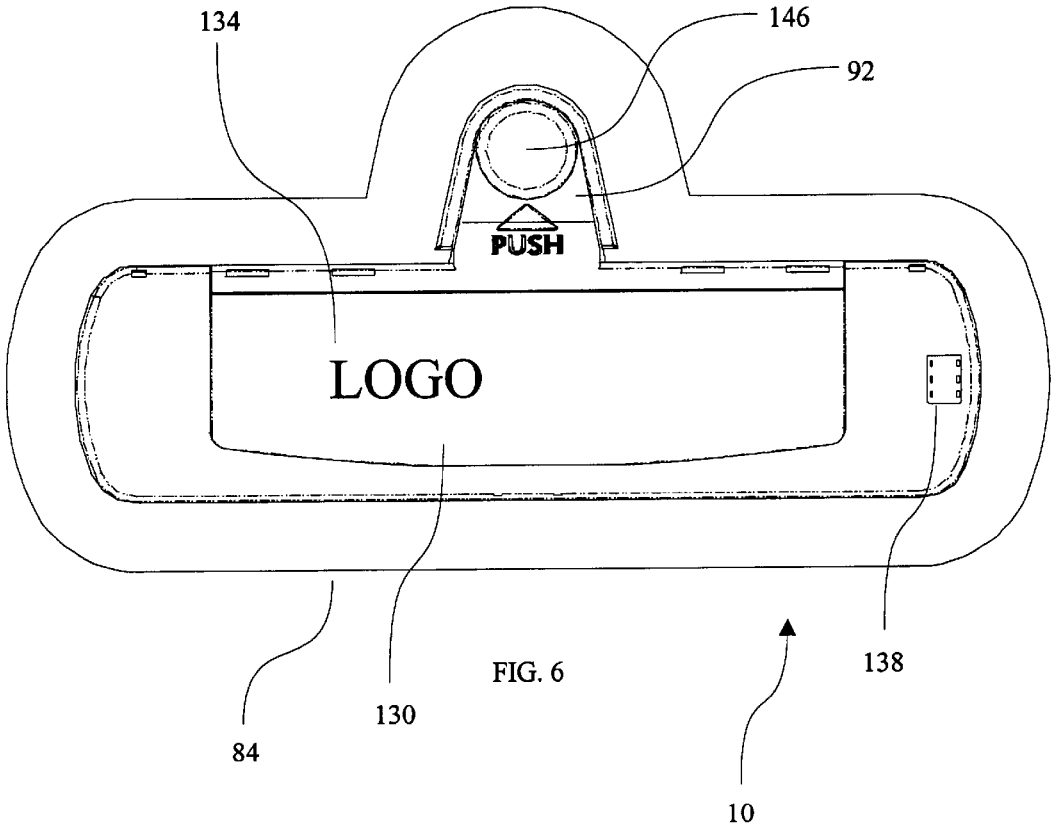
FIG. 6 is a top view of the underground rake storage system of FIG. 1.

In another aspect, the lip 164 of the container 34 can be movably or pivotally coupled to the container 34, and can move or pivot away from the rake 14 and handle 22 as the protrusion 168 pushes against the lip 164 while the rake 14 is inserted into the container 34. In one aspect, the lip 164 can be coupled to the lid 84 or the arm 92, which are pivotally coupled to the container 34, so that the lip 164 is also pivotally coupled to the container. The lip 164 can pivot between a retaining position and a release position. In the retaining position, shown in FIG. 3, the lip 164 is positioned closer to the rake 14 and is engagable by the protrusion 168. The retaining position of the lip 164 can correspond to the open position of the lid 84. In the release position, shown in FIG. 1, the lip 164 is positioned further form the rake 14 and the protrusion 168. The release position of the lip 164 can correspond to the closed position of the lid 84. As the lid 84 pivots to the open position, and as the arm 92 pivots downwardly, the lip 164 pivots towards the rake 14. As the lid 84 pivots to the closed position, and as the arm 92 pivots upwardly, the lip 164 pivots away from the rake 14. Thus, as shown in FIG. 3, after the rake 14 has been pushed 150 into the container 34, the protrusion 168 of the rake abuts to or engages the lip 164 of the container to retain the rake 14 in the container 34. As the lid 84 pivots 154 to the closed position, the lip 164 pivots away from the rake 14, and the rake head 26 is allowed to abut to the lid 84, as shown in FIG. 1.

It has been recognized that certain geographical locations have a higher water table than other locations. It also has been recognized that the container 34 and the rake 14 can have lengths of approximately six feet, which in some geographical locations will extend to the water table. It will be appreciated that it is undesirable to have the rake 14 disposed in a container filled with water, and/or to have users withdraw a rake that is wet. Thus, in one aspect, the container 34 or tube 42 advantageously has a sealed lower end, indicated at 172 (FIGS. 4 and 5), to resist ground water from higher water tables from entering the container 34 or tube 42. It also has been recognized that sealing the lower end of the container 34 or tube 42 also prevents water from draining from the container or tube. Thus, it has been recognized that it would be advantageous to prevent or resist water from entering the container 34 or tube 42.

The container 34 can include a flange 176 formed about the inside of the container 34. In one aspect, the flange 176 can be formed about the upper end of the tube 42, or at the lower end of the tray 46. The rake 14 can include a collar 180 disposed around the rake near the distal end, adjacent the rake head 26. The collar 180 of the rake 14 and the flange 176 of the container can be formed to abut or engage when the rake 14 is disposed in the container 34 to close the container 34 or tube 42 below the collar 180 and flange 176 to resist water and debris from entering the tube 42. The flange 176 can have an upwardly-facing, tapering or angled wall, and the collar 180 can have a downwardly-facing, tapering or angled wall that matches the wall of the flange 176. Thus, the walls match or mate, with the collar 180 nesting in the flange 176 to resist water or debris from passing. In addition, the collar 180 also can form the protrusion 164 of the retaining mechanism 160.

Figure 9A:
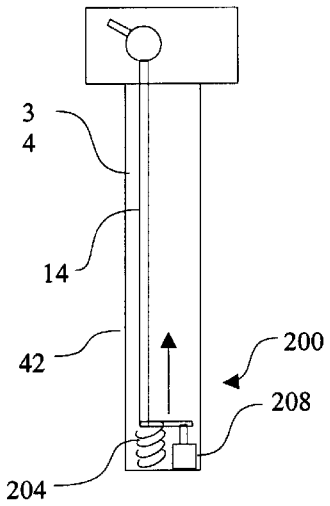
FIGS. 9*a–j* are schematic views of underground rake storage systems in accordance with the present invention.

As stated above, the underground rake storage device 10 advantageously includes a mechanical lifting mechanism for elevating the rake 14. Although a counter weight system 50 has been described above, other types of mechanical lifting mechanisms can be used. Referring to FIG. 9A, the mechanical lifting mechanism can include a compression spring system 200 with a compression spring 204. As the rake 14 is inserted into the container 34, the compression spring 204 is compressed, storing energy. The energy stored by the compressed spring 204 is used to elevate the rake for use. A holding mechanism, such as a two-way latch or pressure release latch 208, can be used to maintain the rake 14 in the container 34. The latch 208 can be disposed in the container 34, such as at the bottom of the main tube 42 to engage the receiver 54 (FIG. 2). The latches 208 respond to unidirectional pressure to both engage and disengage. Thus, the downward force of the rake against the latch causes the latch to operate to engage the receiver, while again forcing the receiver 54 against the latch causes the latch to operate to disengage the receiver.

Figure 9B:
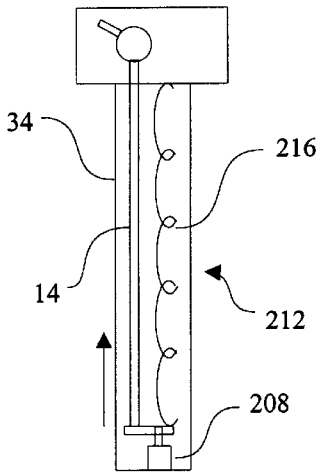

Referring to FIG. 9B, the mechanical lifting mechanism can include an extension spring system 212 with an extension spring 216. As the rake 14 is inserted into the container 34, the extension spring 204 is extends, storing energy. Again, the energy stored by the extended spring 216 can be used to elevate the rake for use. In addition, an elastic member, such as an elastic cord or loop, can be used in place of the extension spring.

Figure 9C:
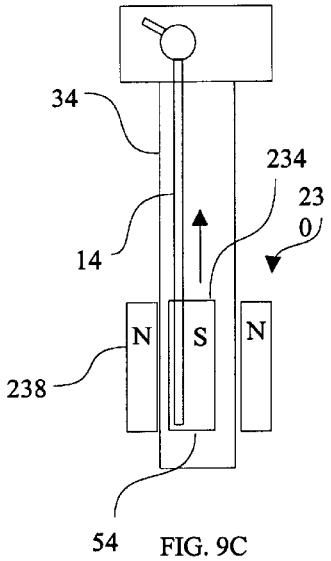

Referring to FIG. 9C, the mechanical lifting mechanism can include a magnet system 230 with magnets 234 and 238. A first magnet 234 can be formed on the rake 14 or on the receiver 54, and can have a first polarity, such as "S", while a second magnet 238 can be disposed in the container 34, and can have a second polarity, such as "N". As the rake 14 is inserted into the container 34, the opposite polarity of the magnets 234 and 238 repel one another. The repelling opposite force of the magnets 234 and 238 can be used to elevate the rake for use. The magnets 234 and 238 can be permanent magnets, or electo-magnets.

Figure 9D:
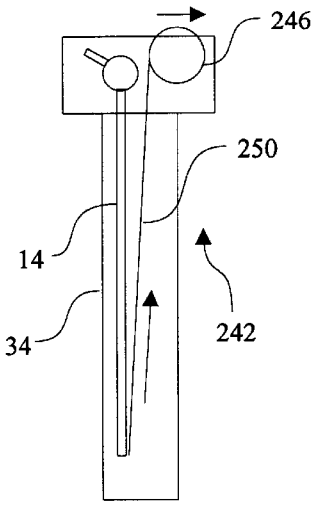

Referring to FIG. 9D, the mechanical lifting mechanism can include a wheel and strap system 242. A wheel 246 can be disposed adjacent the surface 18 with at least a portion extending above the surface 18 so that a user can engage the wheel with his or her foot. The wheel 246 can be attached to a strap 250, which in turn can be coupled to the rake 14 or receiver 54 (FIG. 2). As the wheel 246 is rotated by the user's foot, the strap 250 can be wrapped around the wheel, lifting the rake.

Figure 9E:
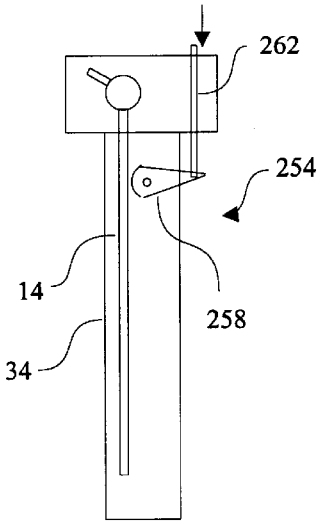

Referring to FIG. 9E, the mechanical lifting mechanism can include a ratchet mechanism 254. The ratchet mechanism 254 can include a pawl 258 that can releasably engage the rake 14 or receiver 54 (FIG. 2). The pawl 258 can repeatedly engage and lift the rake through several small increments. For example, the user can repeatedly operate the pawl 258 or mechanism 254, such as by push on an arm 262 coupled to the pawl.

Figure 9F:
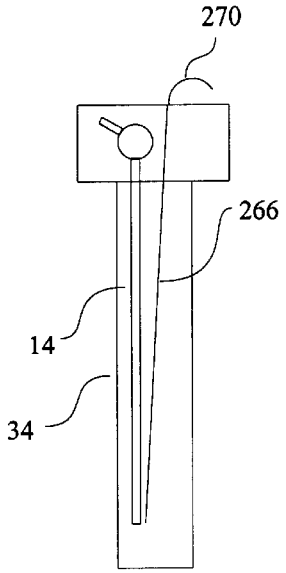

Referring to FIG. 9F, the mechanical lifting mechanism can include a strap 266. The strap 266 can be coupled to the rake 14 or receiver 54 (FIG. 2). A loop 270 or the like can be formed on, or disposed on, the upper end of the strap, and can be positioned at the surface 18. The user can grasp the loop 270 with his or her hand, or with his or her club, and lift the strap 266, and thus the rake 14.

Figure 9G:
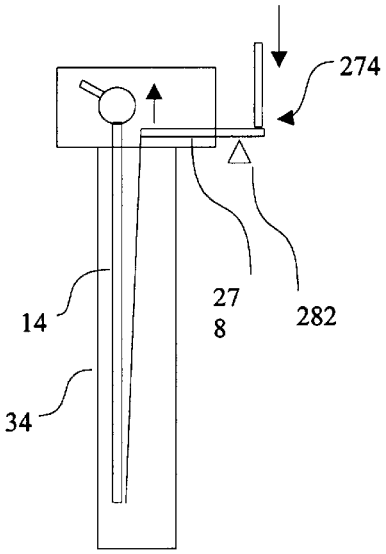

Referring to FIG. 9G, the mechanical lifting mechanism can include a lever mechanism 274. The lever mechanism 274 can include a lever arm 278 and a pivot 282. A long end of the lever arm 278 can engage or be coupled to the rake 14 or receiver 54 (FIG. 2), such as with a strap or cord 286. A short end of the lever arm 278 can be engaged by the user. Thus, the user can push on the short end of the lever arm 278, causing the rake 14 to elevate.

Figure 9H:
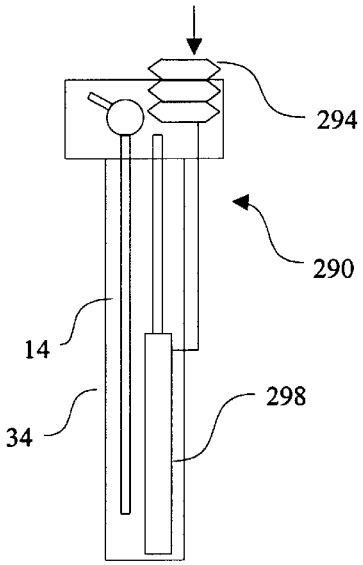

Referring to FIG. 9H, the mechanical lifting mechanism can include a pneumatic system 290. The pneumatic system 290 can include a pump 294 or other source of compressed gas or air. The pump 290 can be a foot pump operable by the user. The pump 294 or air source can be operatively coupled to a piston/cylinder 298. The piston/cylinder 298 can be coupled to the rake 14 or receiver 54 (FIG.2). Air or gas from the pump 290 or air source forces the piton to move in the cylinder, elevating the rake 14. The pump 290 can be used with other gases or fluids.

Figure 9I:
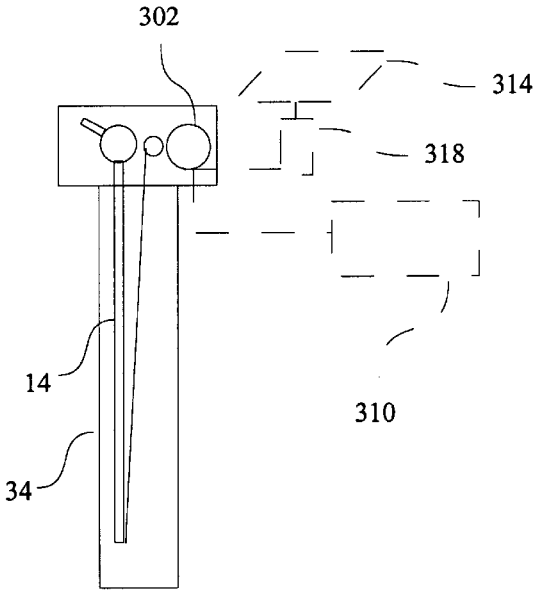

Referring to FIG. 9I, the mechanical lifting mechanism can include a motor 302, or electric motor. The motor 302 can be coupled to a cord or strap 306 that is coupled to the rake 14 or receiver 54 (FIG. 2). The motor 302 can rotatably drive a shaft that is coupled to the cord or strap 306. Alternatively, the motor can utilize a rack-and-pinion to elevate the rake. The motor can be powered by electricity from an electrical source, such as an electrical system 310 from a sprinkling system of a golf course. Alternatively, the electrical source can include a solar cell or panel 314 that charges a battery 318.

Figure 9J:
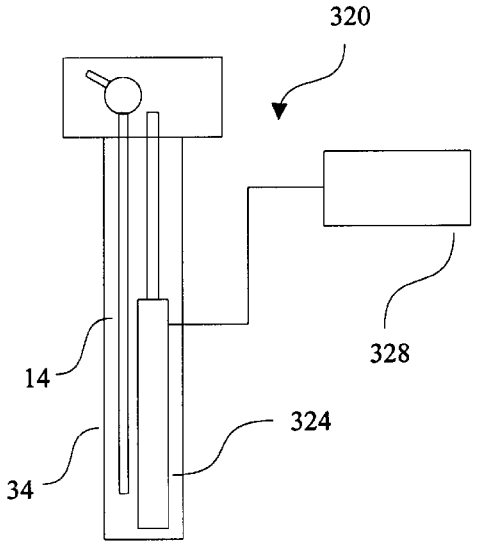

Referring to FIG. 9J, the mechanical lifting mechanism can include a hydraulic system 322. The hydraulic system 322 can include a piston/cylinder 324 operated by hydraulic fluid. The hydraulic fluid can include water from water source 328, such as a sprinkling system of a golf course. Thus, the hydraulic system 322 can utilize the pressurized water from the sprinkling system to elevate the rake. Alternatively, the hydraulic fluid can be pressurized or driven by a hydraulic motor.

A method for using the systems or devices described above, and for substantially concealing and selectively providing the rake 14 adjacent the sand trap of the golf course, includes disposing the elongated container 34 underground, or under the surface 18, adjacent the sand trap of the golf course. As stated above, the elongated container 34 preferably is vertically oriented, but may also be vertically inclined.

In addition, the rake 14 is selectively disposed in the container 34, and thus the rake 14 also is disposed underground or under the surface 18. Similarly, the rake 14 preferably is vertically oriented underground within the container, but may be vertically inclined. The rake 14 may be disposed in the container 34 by inserting the handle 22 of the rake 14 through the opening 38 of the container 34. The rake 14 is preferably inserted with the handle 22 first. The rake 14 may continue to be inserted to the container 34 until the handle 22 is substantially received in the main tube 42, while the head of the rake 14 is received within the tray 46.

In addition, the rake 14 may be inserted in the container 34 by placing the proximal end of the handle 22 into the receiver or receiver tube 54. It will be appreciated that prior to receiving the rake 14, the receiver or receiver tube 54 will be located near the upper end of the container or main tube 42. For example, the counter weight 58, which weighs more than the receiver or receiver tube 54, will cause the counter weight 58 to move towards the bottom of the container 34 or main tube 42, thus lifting the receiver or receiver tube 54 near the top.

Due to the lifting mechanism, such as the counter weight system 50, it may be necessary to exert a downward force on the rake 14 in order to insert the rake 14 into the container 34. Therefore, the rake 14 advantageously is prevented from merely dropping into the container, thus resisting damage. The users may exert a force on the rake 14 using their hands initially, and then complete the act of inserting the rake into the container using their foot or a golf club. As the head 26 of the rake 14 is inserted into the tray 46 of the container 34, the collar 180 or protrusion 168 engages the lip 164, as shown in FIG. 3. The lip 164 can pivot away from the collar 180 or protrusion 168 as the protrusion passes the lip.

The lid 84 can be pivoted closed to maintain the rake 14 in the container 34. The bi-stable mechanism 80 can maintain the lid 84 in the closed position. As the lid 84 pivots to the closed position, the lip 164 can pivot away from the rake 14, allowing the rake head 26 to abut the lid 84, as shown in FIG. 1. Thus, the lip and protrusion retain the rake in the container while the lid is closed. If the user fails to close the lid, the lip and protrusion retain the rake.

It is of course understood that other latching mechanisms may be used. For example, as the receiver or receiver tube 54 nears the bottom of the container 34 or main tube 42 it may engage a two-way latch or pressure sensitive latch 154, which prevents the counter weight system 50 from elevating the rake 14.

When needed, the rake 14 is selectively elevated out of the container 34 by a lifting mechanism, such as the counter weight system 50. The rake 14 preferably is elevated in a substantially vertical direction, and substantially along its longitudinal axis 30. Thus, the length and orientation of the rake 14 facilitates elevating the rake 14 to a convenient elevation. As stated above, the head 26 of the rake 14 preferably is elevated to a grasping elevation greater than 2 or 3 feet.

To elevate the rake 14, the lid 84 is pivoted to the open position by exerting a force 142 on the arm 92. For example, the user can press the end of a golf club into the indentation 146. As the lid 84 is pivoted, the spring element 96 or spring causes the lid 84 to pivot fully to the open position. In addition, the lid 84 is pivoted from above the rake 14 allowing the lifting mechanism, such as the counter weight system 50, to elevate the rake 14.

As stated above, the weight of the counter weight 58 preferably is slightly greater than the combined weight of the rake 14 and the receiver or receiver tube 54. This slight mismatch in weight, and any frictional properties of the pulley 66, result in the counter weight system 50 gradually elevating the rake 14. Thus, the counter weight 58 gradually overcomes inertia and builds momentum, causing the rake 14 to gradually elevate from the container 34. The gradual elevation of the rake 14 advantageously prevents any surprise or injury, which may result from a rapidly ejecting rake 14.

It is of course understood that the rake 14 may be elevated with any type of lifting mechanism. In addition, the rake 14 may be selectively elevated in different ways depending on the latching mechanism. For example, if a two-way latch or pressure sensitive latch is used, a downward force may be applied to the head 26 of the rake 14 causing the two-way latch or the pressure sensitive latch 154 to release.

The underground rake storage or device of the present invention provides significant advantages, including both substantially concealing the rake 14, and selectively elevating the rake to a convenient grasping elevation. Disposing the rake 14 in container 34 underground reduces the risk that the rake 14 or container 34 will interfere with a golf ball or play of the game. Providing the container 34 flush with the surface 18 allows the location of the rake 14 to be easily ascertained, when needed. The underground rake storage system or device of the present invention has a low profile which maintains the esthetic appearance of the golf course, reduces the need for maintenance workers to move rakes during maintenance of the course, reduces the risk of broken rake handles, protects fiberglass rake handles from sunlight, and reduces the risk of injury.

In addition, elevating the rake 14 reduces the need for the golfer or user to bend over, squat, or kneel in order to retrieve the rake 14. The movement of the rake 14 as it is elevated is graceful and sophisticated, adding to the esthetics of the golf course and the convenience of the players. In addition, the latching mechanism allows the player or user to selectively elevate the rake from a standing position.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A rake storage system configured to store a rake adjacent a sand trap of a golf course, and configured to selectively elevate the rake for use, the device comprising:

a) an elongated container configured to be disposed underground adjacent the sand trap in a substantially vertical orientation;

b) a rake, removably disposed within the elongated container, having a distal end with a rake head and a proximal end;

c) a mechanical lifting mechanism, disposed in the elongated container, to elevate the rake; and d) a releasable retaining mechanism to retain the rake in the container, including:

1) a lip, formed in the container; and 2) a protrusion, disposed on the rake near the distal end adjacent the rake head, engagable with the lip to retain the rake in the container when the rake is disposed in the container.

2. A system in accordance with claim 1, wherein the lip is pivotally coupled in the container.

3. A system in accordance with claim 1, further comprising:

a collar, disposed around the rake near the distal end adjacent the rake head, and forming the protrusion.

4. A system in accordance with claim 3, further comprising:

a flange, formed about the inside of the container; and the collar being disposed at the flange when the rake is received within the container to substantially close the container below the flange and the collar.

5. A system in accordance with claim 4, wherein the container includes a sealed lower end.

6. A system in accordance with claim 4, wherein the flange includes an upwardly-facing, tapering wall; and wherein the collar includes a downwardly-facing, tapering wall that matches the upwardly-facing, tapering wall of the flange.

7. A system in accordance with claim 1, further comprising:

a lid, pivotally coupled to the container, and pivotal between: (i) an open position in which the rake can be removed from and inserted into the container; and (ii) a closed position covering an open upper end of the container.

8. A system in accordance with claim 7, wherein the lip is pivotally coupled to the container, and pivots between:

a retaining position closer to the rake and engagable by the protrusion when the lid is in the open position; and a release position further from the rake and the protrusion when the lid is in the closed position.

9. A system in accordance with claim 7, wherein the lid is sized to extend over the open upper end of the container, and includes a downwardly-extending ridge extending past the open upper end of the container when the lid is in the closed position.

10. A system in accordance with claim 7, further comprising indicia, formed on the lid, that indicates a distance to a green of the golf course.

11. A system in accordance with claim 7, wherein the mechanical lifting mechanism is selected from the group consisting of: a counter weight system; a compression spring system; an extension spring system; an elastic system; a magnetic system; a ratchet mechanism; a wheel and strap system; a lever system; a pneumatic system; a hydraulic system; an electric motor system; and a strap system.

12. A rake storage system configured to store a rake adjacent a sand trap of a golf course, and configured to selectively elevate the rake for use, the device comprising:

a) an elongated container configured to be disposed underground adjacent the sand trap in a substantially vertical orientation;

b) a rake, removably disposed within the elongated container; and c) a mechanical lifting mechanism, disposed in the elongated container, to elevate the rake.

13. A system in accordance with claim 12, further comprising:

a releasable retaining mechanism to retain the rake in the container, including:

1) a lip, formed in the container; and 2) a protrusion, disposed on the rake near the distal end adjacent the rake head, engagable with the lip to retain the rake in the container when the rake is disposed in the container.

14. A system in accordance with claim 13, further comprising:

a collar, disposed around the rake near the distal end adjacent the rake head, and forming the protrusion.

15. A system in accordance with claim 13, further comprising:

a lid, pivotally coupled to the container, and pivotal between: (i) an open position in which the rake can be removed from and inserted into the container; and (ii) a closed position covering an open upper end of the container.

16. A system in accordance with claim 15, wherein the lip is pivotally coupled to the container, and pivots between:

a retaining position closer to the rake and engagable by the protrusion when the lid is in the open position; and a release position further from the rake and the protrusion when the lid is in the closed position.

17. A system in accordance with claim 12, wherein the mechanical lifting mechanism is selected from the group consisting of: a counter weight system; a compression spring system; an extension spring system; an elastic system; a magnetic system; a ratchet mechanism; a wheel and strap system; a lever system; a pneumatic system; a hydraulic system; an electric motor system; and a strap system.

* * * * *